US005803322A

United States Patent [19]

Boone et al.

[11] Patent Number: 5,803,322

[45] Date of Patent: Sep. 8, 1998

[54] STITCH LAYING TOOL

[76] Inventors: David I. Boone; Lilias L. Ralph, both of 6917 Black Pine Pl. NE., Albuquerque, N. Mex. 87109

[21] Appl. No.: 851,323

[22] Filed: May 5, 1997

[51] Int. Cl.[6] ..... D05B 91/04; A41D 13/00

[52] U.S. Cl. ..... 223/101; 2/21

[58] Field of Search ..... 223/101; 2/21, 2/163, 161.6

[56] References Cited

U.S. PATENT DOCUMENTS

| | | | |
|---|---|---|---|
| 883,761 | 4/1908 | Taylor | 2/21 |
| 1,184,710 | 5/1916 | Baumann | 2/21 |
| 1,220,007 | 3/1917 | Rowley | 223/101 |
| 1,260,187 | 3/1918 | Gourley | 223/101 |
| 1,473,953 | 11/1923 | Dart | 223/101 |
| 1,822,953 | 9/1931 | Bruening | 223/101 |
| 2,297,714 | 10/1942 | Nesbitt | 223/101 |
| 2,597,564 | 5/1952 | Bugg | 223/101 |
| 2,704,889 | 3/1955 | Delinanos | 223/101 |
| 5,234,142 | 8/1993 | Loewen et al. | 223/101 |

OTHER PUBLICATIONS

"Trolley Needle Thread Controller"—Flyer Old Post Yarn Works, Ltd., Saugatuck, MI 1980.

*Primary Examiner*—Bibhu Mohanty
*Attorney, Agent, or Firm*—Zarley, McKee, Thomte, Voorhees & Sease

[57] ABSTRACT

A stitch laying tool has a cylindrical thimble body having a center axis and a cylindrical side wall with opposite open ends to receive the tip of a stitcher's finger. An elongated stiff wire is secured to the side wall and extends substantially parallel to the center axis and has an outer end extending beyond one end of the cylindrical side wall. The outer end of the stiff wire has a short straight wire segment which forms an angle with respect to the stiff wire.

6 Claims, 2 Drawing Sheets

STITCH LAYING TOOL

BACKGROUND OF THE INVENTION

One of the difficulties in cross stitching is that the threads, and hence, the stitches often become twisted so that when the stitch is pulled closed, the resulting appearance of the completed stitch is untidy by reason of the twisted thread.

Some tools have been made to lay or pull the thread in a direction extending away from the stitch location to minimize the twisting of the thread. However, existing tools for this purpose are awkward and cumbersome to use.

It is therefore a principal object of this invention to provide a stitch laying tool that allows the hand to be a natural position while being used, and which will effectively and efficiently prevent the thread from being twisted.

These and other objects will be apparent to those skilled in the art.

SUMMARY OF THE INVENTION

A stitch laying tool has a cylindrical thimble body having a center axis and a cylindrical side wall with opposite open ends to receive the tip of a stitcher's finger. An elongated stiff wire is secured to the side wall and extends substantially parallel to the center axis and has an outer end extending beyond one end of the cylindrical side wall. The outer end of the stiff wire has a short straight wire segment which forms an angle with respect to the stiff wire.

DESCRIPTION OF THE PREFERRED EMBODIMENT

Figure 2:
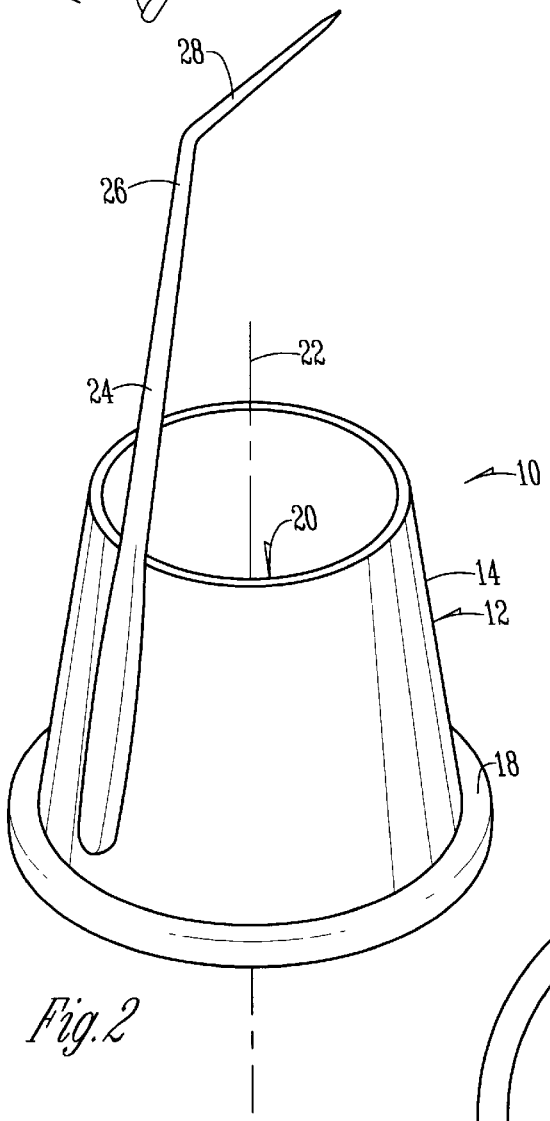
FIG. 2 is an enlarged scale view thereof with the tool of this invention being in an inverted position.
Figure 3:
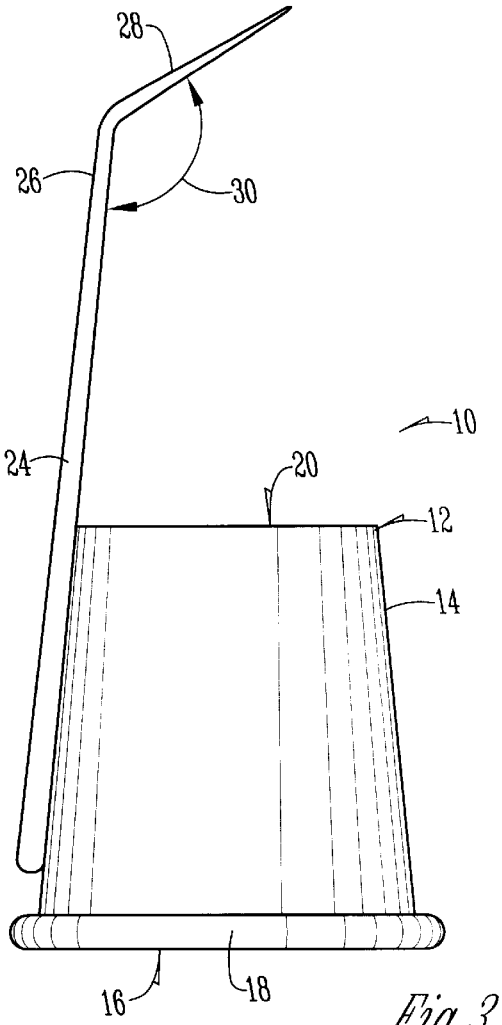
FIG. 3 is a side elevational view of the device of FIG. 2.
Figure 4:
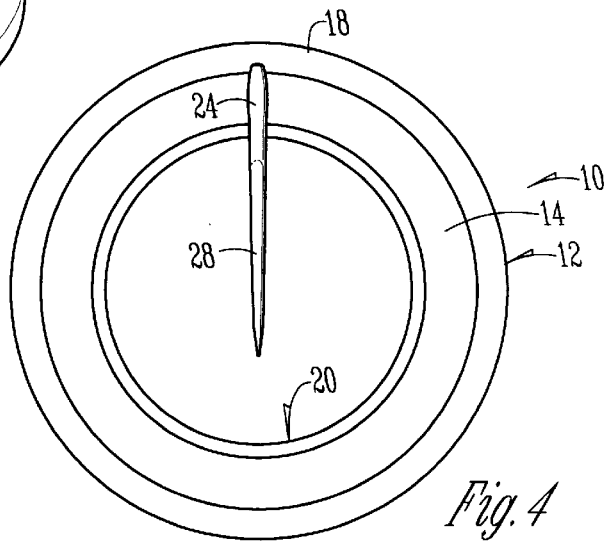
FIG. 4 is a plan view of FIG. 3 as viewed from the right-hand side of FIG. 3.

The tool 10 is comprised of a ring or a cylindrical thimble body 12 having a cylindrical, and slightly truncated, side wall 14. The wall 14 has a open top and 16 (shown in a downward position in FIGS. 2 and 3) which is encircled by rim 18. The wall 14 has an open bottom end 20 and a center axis 22. The principal purpose of the open end 20 is to permit the tip of the operator's finger to extend slightly therethrough along with the fingernail on that fingertip, all as described hereafter.

An elongated stiff wire 24 is welded or otherwise secured to the outer surface of wall 14. Wire 24 has an outer end 26 which extends beyond the bottom end 20 of the wall a distance substantially equal to the vertical height of the ring 12. The outer end 26 terminates in a straight wire segment 28 which is bent at an angle of approximately 135° with respect to the principal length of the wire 24. The 135° angle is designated by the numeral 30 in FIG. 3.

Figure 1:
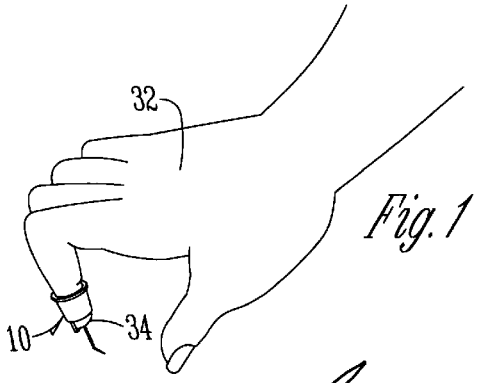
FIG. 1 is a perspective view of the device of this invention on the finger of a stitcher.
Figure 5:
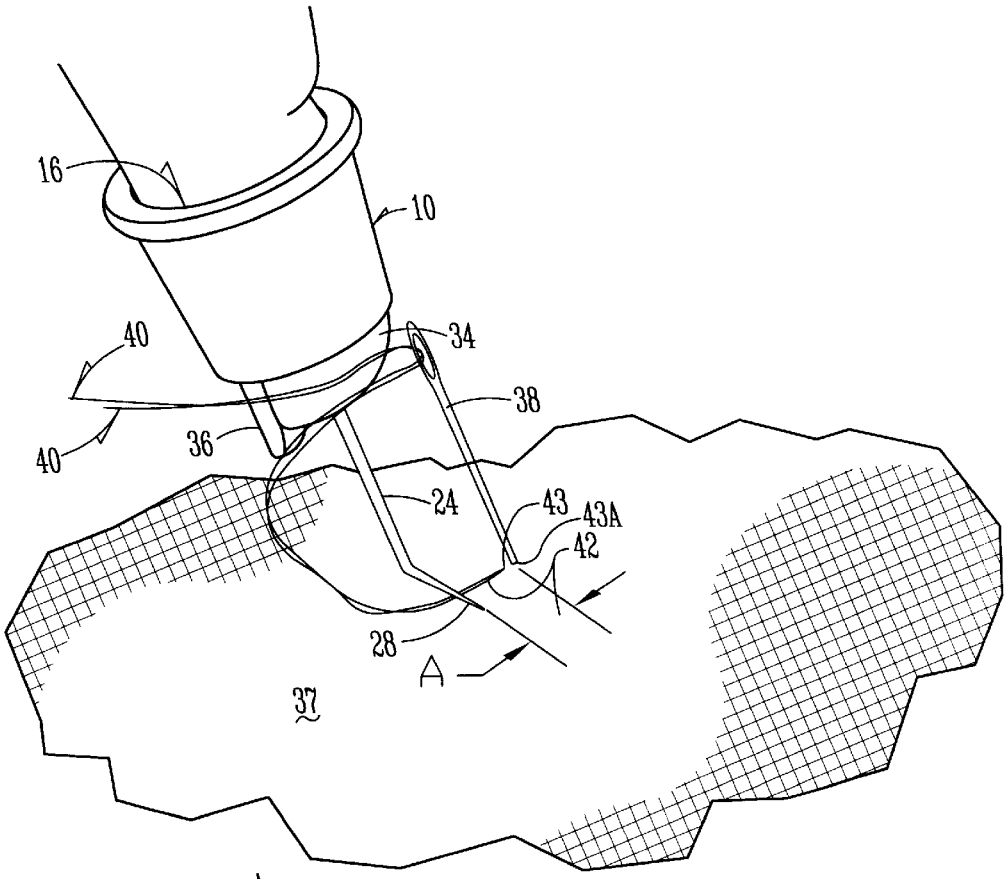
FIG. 5 is a partial perspective view of the device of this invention in its initial operational stage.
Figure 6:
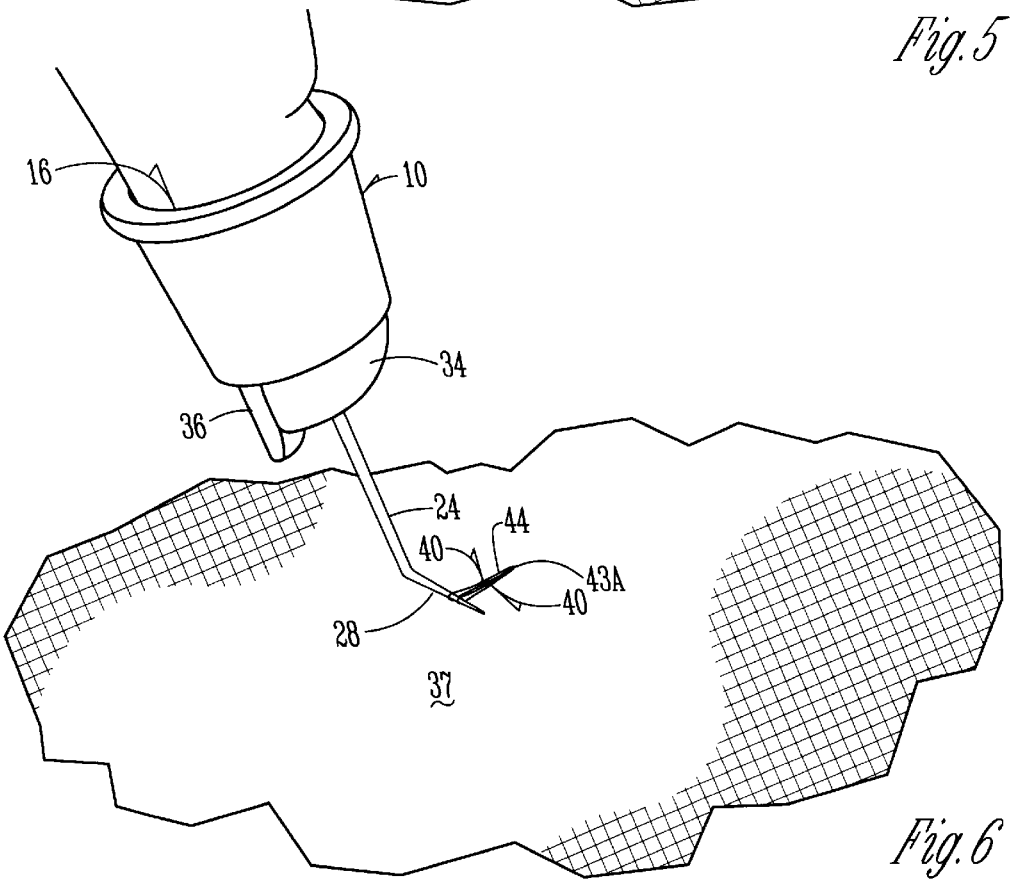
FIG. 6 is a view similar to that of FIG. 5 showing the use of the tool in a further stage of operation.

An operator's hand 32 with fingertip 34 and fingernail 36 thereon typically extends through the ring 12 and protrudes slightly from the bottom end 20 thereof (FIGS. 5 and 6). The operational position of the tool 10 is best shown in FIGS. 1, 5 and 6. The fabric 37 upon which the stitching is to take place typically receives an elongated needle 38 which is extendible therethrough. One end of the needle is secured to elongated threads 40. A short straight segment of the thread is designated by the letter A (see numeral 42) in FIG. 5. Segment 42 extends in a straight direction away from the point 43 at which the threads 40 exit the fabric 37. As will be described hereafter, the numeral 44 shows a thread loop (formed in threads 40) as the needle and threads 40 of FIG. 5 are pulled through the fabric 37 at point 43A adjacent point 43.

The tool of this invention allows the hand to be in a natural position while being used. In use, the ring 12 is placed on either the index or the middle finger with wire 24 positioned therebetween. When the threads have come up through the fabric, the straight wire segment 28 is placed on the thread segment 42 as best shown in FIG. 5 to hold threads 40 against the fabric 37. This insures that the thread segment 42 is not twisted and insures that the threads 40 in segment 42 are laying side by side and are not twisted. The conventional half cross stitch is then made while the stitch segment 42 is held in place. As the thread is pulled through to the underside of the fabric 37, the wire segment 28 remains on top of the thread segment 42 until the loop 44 (FIG. 6) is formed. As the thread is then pulled gently through the fabric 37, the loop 44 is drawn towards the point 43A in the fabric through which the thread extends with the thread of the loop 44 being held in a flat position on the fabric 37. This will ensure that the threads 40 in loop 44 will be laying side by side providing the maximum coverage. When the loop 44 is pulled tight, the straight wire segment 28 is gently withdrawn from the loop.

By rotating the ring 12 on the operator's finger, it is possible to place the straight wire segment 28 in many positions for use in making many stitches in cross stitch, needlepoint, crewel or silk. It helps control multiple threads for short or long stitches, and helps eliminate twisted threads and facilitates the use of metallic threads. It also enhances the appearance of silk ribbon stitches. Cross stitches will a have a fuller look because all threads will be laying side by side for maximum coverage.

From the foregoing, it is seen that this invention will achieve at least all of its stated objectives.

What is claimed is:

1. A stitch laying tool, comprising, a cylindrical thimble body having a center axis and a cylindrical side wall having opposite open ends to receive the tip of a stitcher's finger, an elongated stiff solid wire secured to said side wall and extending substantially parallel to said center axis and having an outer end extending beyond one end of said cylindrical side wall, said outer end having a short straight wire segment forming an angle with respect to said stiff wire, and terminating in a tapered sharp point to permit the sharp point to be easiliy inserted into and removed from a thread loop and the wire segment pointing inwards toward the center of the thimble.

2. The stitch laying tool of claim 1 wherein said stiff wire is straight except for said straight wire segment.

3. The device of claim 1 wherein said angle is approximately 135° in magnitude.

4. The device of claim 1 wherein said stiff wire except for said straight segment extends beyond said side wall a distance substantially equal to the length of said thimble body between said open ends.

5. The device of claim 1 wherein said open opposite ends have different diameters.

6. The device of claim 1 wherein said straight wire segment is shorter than the length of said stiff wire that extends beyond said thimble body.

* * * * *